United States Patent [19]

Habeck et al.

[11] 3,971,166

[45] July 27, 1976

[54] BELT POSITION SENSOR FOR WIDE BELT SANDING MACHINE

[75] Inventors: Gerald E. Habeck, Princeton; Fred W. Kiser, Hopkins, both of Minn.

[73] Assignee: Timesavers, Inc., Minneapolis, Minn.

[22] Filed: June 9, 1975

[21] Appl. No.: 585,063

[52] U.S. Cl. ..... 51/135 BT

[51] Int. Cl.[2] ..... B24B 21/18

[58] Field of Search ..... 51/135 R, 135 BT; 74/241; 198/202; 242/57.1; 137/83

[56] References Cited

UNITED STATES PATENTS

| | | | |
|---|---|---|---|
| 2,274,268 | 2/1942 | Hercik | 51/135 BT |
| 2,587,603 | 3/1952 | Czarnecki | 51/135 BT |
| 3,118,314 | 1/1964 | Schuster | 74/241 |
| 3,159,170 | 12/1964 | Callan | 242/57.1 X |
| 3,310,942 | 3/1967 | Stanford | 242/57.1 X |
| 3,447,306 | 6/1969 | Jakimcius | 51/135 BT |
| 3,552,067 | 1/1971 | Przygocki | 51/135 BT |
| 3,900,973 | 8/1975 | Van Der Linden | 51/135 BT |

*Primary Examiner*—Al Lawrence Smith
*Assistant Examiner*—Nicholas P. Godici

[57] ABSTRACT

A sensor assembly comprises a U-shaped support straddling an edge portion of a straight stretch of the abrasive belt of a sanding machine. Each leg of the U-shaped support has three air discharge nozzles spaced along its length, each nozzle on one leg being aligned with and opposing a nozzle on the other so that streams of air issuing from the opposing nozzles, unless intercepted, impinge upon one another. Low pressure air is blown out of the nozzles on one leg, high pressure air out of those on the other. Either of two pressure conditions can thus exist upstream of each low pressure nozzle, depending upon whether or not a part of the belt intervenes between it and its opposing high pressure nozzle. The center pair of nozzles senses normal tracking conditions, the outer pairs respond to edgewise excursion of the belt beyond the tracking zone.

2 Claims, 4 Drawing Figures

LINE
TO BRAKE

BELT POSITION SENSOR FOR WIDE BELT SANDING MACHINE

This invention relates generally to wide belt sanding or abrading machines wherein an endless abrasive belt is trained around a pair of spaced apart rollers, one of which is driven and the outer of which is movable to effect controlled edgewise exursions of the belt; and the invention is more particularly concerned with means for sensing edgewise excursions of the belt in either direction beyond a predetermined tracking zone to which the belt is normally confined, to enable the driven roller to be stopped promptly upon the occurrence of such an excessive edgewise displacement of the belt.

In a sanding or abrading machine of the character here under consideration, the driven roller turns about a fixed axis and comprises a contact drum that serves as a backup for the portion of the belt that is engaged with a workpiece. The other roller is a belt tensioning idler and hence is bodily movable toward and from the contact drum as well as tiltable or rockable about an axis which transversely intersects the axes of both rollers. It is the tilting of this idler roller alternately in opposite directions that causes the belt to move edgewise relative to both rollers, the direction of that motion being dependent upon the direction in which the idler roller is tilted.

U.S. Pat. No. 3,118,314 to G. L. Schuster, issued in 1964, discloses apparatus by which tilting of the idler roller can be so controlled that the edgewise excursions of the belt normally do not carry it outside a predetermined tracking zone. In general, the apparatus therein disclosed comprises a pneumatic motor which is connected with the tiltable mounting for the idler roller, to effect the tilting thereof, and sensing means responsive to the position of at least one edge of the belt and so connected with the pneumatic motor as to effect the proper tilting of the idler roller that will confine the belt within the tracking zone.

It might be mentioned that a more or less constant edgewise back and forth migration of the belt within the tracking zone is desirable, to promote even wear across the entire width of the belt and thus prolong its useful life. The tracking zone is therefore somewhat wider than the belt itself.

However, an excursion of the belt beyond the limits of the tracking zone is a trouble signal. Such as excessive excursion may be the result of a failure in the tilting mechanism or its control system, or it may be occasioned by a partial stretching or breaking of the belt. Whatever its cause, edgewise movement of the belt beyond the limits of the tracking zone should bring about a prompt stopping of the contact drum. To effect such stopping, a brake system is associated with the electric motor that drives the contact drum, and of course the electric motor is de-energized concurrently with application of the brake. There must also be sensing apparatus which responds to an excessive excursion of the belt to effect control of the electric motor and the brake.

Heretofore the means for sensing an out-of-bounds migration of the belt has cmprised either a photoelectric cell or a switch having a feeler that was physically engaged by the belt when the belt moved out of the tracking zone. Both of these types of sensors were ill-suited to sanding or abrading machines. A photoelectric sensor is soon rendered useless by the inevitable dust produced by an operating abrasive belt. A mechanical feeler that is physically contacted by the belt will of course be abraded by every such engagement and will need replacement after a limited number of operations. But since operation of the machine is not dependent upon operativeness of the sensor used to detect any out-of-bounds migration of the belt, the condition of the sensor was seldom checked. As a result the sensor could not be relied upon to stop the machine when the emergency arose.

What is obviously needed is an out-of-bounds sensor which does not have to be physically contacted by the belt and which is not adversely affected by the high concentration of dust in its environment.

The teachings of the Schuster patent did not offer a suggestion for fulfilling this need.

As disclosed in the patent, the belt tracking sensor comprised an air outlet orifice in the cylindrical surface of the belt tensioning idler roller, communicated with an axial air passage in the roller. Pressure air from a pressure air line was introduced into that passage through a rotating bearing seal that was somewhat complicated and expensive. When the belt was near one side of the tracking zone, it covered the outlet orifice in the idler roller during one half of each revolution thereof, creating a back pressure in the pressure air line that could be sensed and caused to produce an appropriate tilting of the idler roller whereby the belt was induced to move towards the opposite edge of the tracking zone. In some cases the idler roller was provided with a second outlet orifice, near the opposite edge of the tracking zone, and the two orifices cooperated to control belt migrations within the tracking zone. In other cases, the idler roller was biased for tilting in one direction and was tilted in the opposite direction by a motor under the control of a single orifice sensor.

It is apparent that the principles of the Schuster patent could not be employed for both normal tracking control and for out-of-bounds sensing, because at least three sensors are needed for these functions, of which at least one is required for normal tracking control and each of the other two detects out-of-bounds movement of the belt in one of its two edgewise directions. Connecting only one pressure air inlet to each end of the idler roller poses the need for at least two rotary seals; connecting a third inlet to the rotating roller is perhaps not impossible but it can hardly be considered practical. However, the idler roller is a logical location for an air orifice sensor because the belt snugly engages that roller and can therefore make a good seal across the mouth of an orifice therein when it covers the same.

It is the general object of the present invention to provide an out-of-bounds sensor for a wide belt sanding machine thereby edgewise movement of the abrasive belt outside of its normal tracking zone can be detected, which sensor functions without contact with the belt and is capable of prolonged and dependable operation in an extremely dusty environment without the need for maintenance or attention.

More specifically, it is an object of the invention to provide a non-contact out-of-bounds sensor which can be mounted at a stationary location adjacent to a straight stretch of the belt and which is long-lived and effectively self cleaning, hence well suited to an extremely dusty environment.

Another specific object of this inventon is to provide a very compact and efficient assembly comprising tracking and out-of-bounds sensor means for a wide belt sanding machine, which assembly can be fixed adjacent to a straight stretch of the belt, requires no rotary seals, makes no contact with the belt so that it cannot be abraded thereby, and is effectively self-cleaning.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which.

Figure 2:
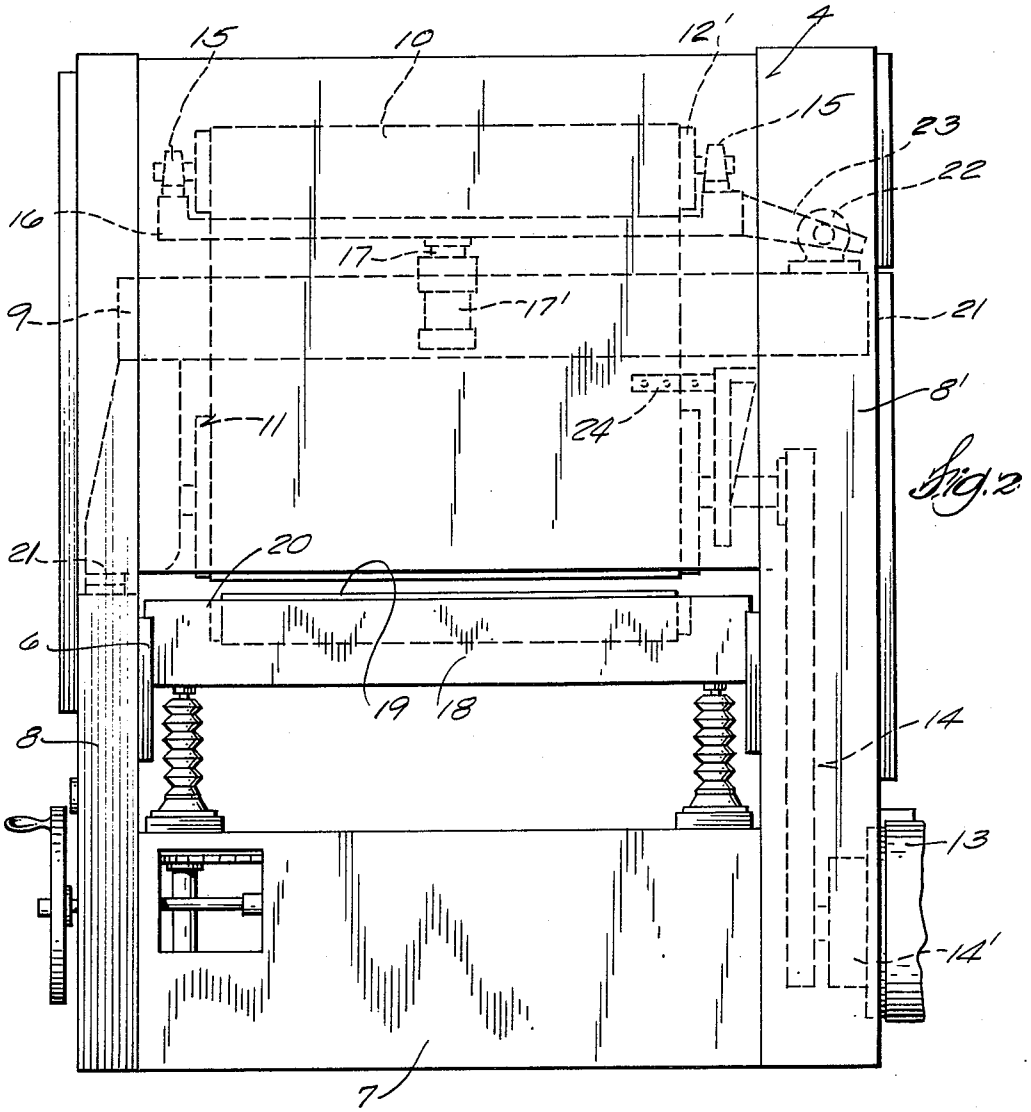
FIG. 2 is an end view of the machine, also more or less diagrammatic and viewing the same from its infeed end.
Figure 1:
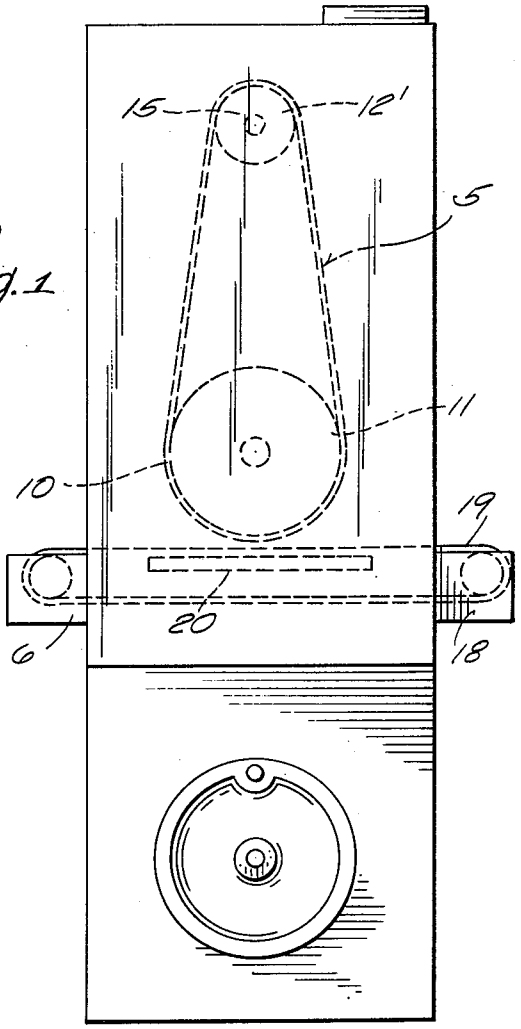
FIG. 1 is a more or less diagrammatic side view of a wide belt sanding machine embodying the principles of this invention.

Referring now to the accompanying drawings, the numeral 4 designates generally the main frame of the machine, in the upper portion of which there is a conventional abrading head 5 and in the lower portion, a work-feeding assembly 6.

The main frame — which is preferably a weldment — has a base section 7 and spaced short and tall side sections 8 and 8' respectively rising from the base section. Rigidly fixed to the tall side section 8' and extending cantilever fashion therefrom towards the other side of the machine is a horizontal arm 9, which in the industry is known as a center bar. It is this center bar that carries the abrading head.

Since the abrading head is conventional it comprises an endless abrasive belt 10 trained over a contact drum 11 and an idler roller 12'. The contact drum is journaled in bearings fixed to and depending from the underside of the center bar, for rotation about a fixed axis, and is drivingly connected with an electric motor 13 through a suitable drive transmission 14. A conventional brake indicated at 14' provides means for quickly stopping the contact drum.

The idler roller is journaled in bearings 15 on the arms of a yoke 16 that is supported above the center bar by the ram 17 of an air cylinder 17' mounted on the center bar. Hence the idler roller 12 can be raised to tension the abrasive belt and lowered to enable the belt to be removed and replaced when necessary.

The work feeding assembly as is customary in wide belt sanding machines comprises a frame 18 which carries an endless power driven conveyor belt 19, the upper stretch of which rides on a platen 20 and carries the workpieces through the machine, with the top surface thereof in engagement with the contact drum supported abrasive belt. To accommodate workpieces of different thicknesses the elevation of the frame 18 is adjustable.

Since the work is fed against the abrasive belt with considerable force, and since exact parallelism is necessary between the contact drum and the platen-supported upper stretch of the conveyor belt, it is evident that the abrading head must be solidly supported against any possible deflection. Accordingly, the outboard end of the center bar as well as its anchored end must be rigidly tied to the frame of the machine. For this purpose a separable connection, designated generally by the numeral 21, connects the outboard end of the center bar with the short side section 8 of the machine frame. This separable connection is preferably like that of the Bernu U.S. Pat. No. 3,777,442 issued Dec. 11, 1973 to the assignee of this invention.

The yoke 16 in which the idler roller is journaled not only is vertically adjustable for belt tensioning purposes but also tiltable or rockable about the axis of the ram 17, which axis intersects the axes of the contact drum and the belt tensioning idler roller midway of the length thereof.

A double acting air cylinder or motor 22 is mounted on the center bar in position to have its ram bear against an arm 23 on the yoke to tilt or rock the yoke in one direction upon projection of the ram. As will be later described a biasing force acting on the ram resists its projection. Details of the tilting mechanism are not shown because various arrangements suitable for the purpose are disclosed in the abovementioned Schuster patent. Suffice it to say that tilting of the idler belt tensioning roller is normally so controlled that the belt is confined in its edgewise excursions to a predetermined tracking zone.

As pointed out above, edgewise movement of the belt beyond the limits of the tracking zone should occasion a prompt stopping of the contact drum, and for this to occur it is necessary that the machine be provided with two reliable sensors, one for detecting out-of-bounds movement of the belt in each direction. According to the present invention, the two sensors for detecting out-of-bounds edgewise belt movement are incorporated into a single sensor assembly 24 that also comprises a tracking sensor for controlling operation of the air cylinder or motor 22 to effect controlled edgewise movements of the belt within the tracking zone.

The sensor assembly 24 comprises a generally U-shaped arm or support 25 mounted on a stationary part of the machine frame in position to straddle the edge portion of one stretch of the belt that is adjacent to the anchored end of the center bar.

Each of the legs 26 and 27 of the U-shaped arm has three air discharge nozzles thereon that are spaced apart lengthwise along it and each of which opens towards the other leg. Each of the nozzles 28, 29, 30 in the leg 26 is in coaxial alignment with a cooperating nozzle 31, 32, 33 in the leg 27. The pair of nozzles 28, 31 nearest the bight of the U-shaped supporting arm comprises an out-of-bounds sensor for detecting excessive belt excursions in one direction, and when the belt is tracking normally it is spaced some distance from that nozzle pair. The pair of nozzles 30, 33 comprises a second out-of-bounds sensor, for detecting excessive belt excursions in the opposite direction, and has a marginal portion of the belt normally interposed therebetween. The center pair of cooperating nozzles 29, 32 comprises the tracking sensor that provides for control of the pneumatic tilting motor 22.

Before proceeding to a more detailed explanation of the three sensors and their operation, general consideration must be given to the pneumatic system in which they are incorporated. In the following explanation, specific pressure value figures are set forth merely by way of example; the given values are by no means critical.

Pressure air from a source thereof, such as a pump 34, is fed into the system, through a conventional filter 35, at a pressure of 70 p.s.i. Through one branch inlet line such pressure air is fed to a pressure regulator 36 that is set for 20 p.s.i., and such 20 p.s.i. pressure air is in turn fed through branching ducts to a slide valve 37, to a solenoid actuated valve 38 and to one side of the pneumatic tilting motor 22.

The slide valve 37 is manually adjustable and is connected with the belt tensioning cylinder 17' to so control delivery of pressure air to it as to maintain desired belt tension. The solenoid actuated valve 38 controls delivery of pressure air to the brake mechanism 14' for the contact drum, and when its solenoid is energized the brake is applied. The 20 p.s.i. pressure air delivered to one port of the double-acting pneumatic tilting motor 22 tends to move it in one direction and hence biases the idler roller in one direction of its tilting motion.

Through a second branch inlet line the incoming 70 p.s.i. pressure air is delivered to another pressure regulator 39 that is set 40 p.s.i. That regulator is connected with the other port of the pneumatic tilting motor 21 through a pneumatic relay 40. The pneumatic relay is controlled by the tracking sensor comprising the air orifices 29, 32, as described below. At this point it should be observed that when the pneumatic relay provides for the delivery of 40 p.s.i. pressure air to the tilting motor, such pressure air overcomes the effect of the 20 p.s.i. pressure air applied to it through its port connected with the regulator 36, and the idler roller is thus tilted in the direction opposite to that in which it is biased.

Through a third branch of the inlet line the incoming pressure air at 70 p.s.i. is delivered to another pressure regulator 41 that is set to 60 p.s.i. That regulator is communicated with the three nozzles 28, 29, 30 on the leg 26 of the U-shaped arm. Those nozzles can be regarded as the high pressure or input orifices of the air sensors, while their cooperating nozzles 31, 32, 33 on the other leg 27 can be considered low pressure or output orifices.

The pneumatic system also comprises a regulator 43 which is shown as having an inlet connection with the 40 p.s.i. regulator 41 and which is set to maintain a 3 p.s.i. pressure at its output. The 3 p.s.i. output of regulator 43 is fed to the inlet of each of the nozzles 31, 32, 33. Associated with each of these nozzles, upstream from it, is a back pressure chamber 44, which can in each case comprise merely a zone in the duct forming the low pressure line connected to these nozzles.

It will now be apparent that a low pressure air stream issues from each of the nozzles 31, 32, 33 and blows towards its opposing nozzles 28, 29, 30, while a much more forceful air stream issues from each of the nozzles 28, 29, 30 and blows towards its respective opposing nozzle. If the belt is not interposed between a pair of opposite nozzles (e.g. 28–31), a substantially high back pressure will be manifested at the back pressure chamber 44 communicated with the low pressure nozzle of that pair. If the belt interposes itself between a pair of opposing nozzles, in effect breaking the force of the high pressure air stream, such back pressure will be substantially lower. Thus the back pressure that prevails at the back pressure chamber for each low pressure nozzle will have a magnitude that depends upon whether or not a part of the belt is in line with that nozzle.

Whatever the position of the belt, pressure air issuing from each nozzle will repel dust particles from it, so that each of the nozzles is self-cleaning. Furthermore, there can be a substantial axial distance between the opposing nozzles of each pair, which is to say that the two legs 26 and 27 of the U-shaped arm can be spaced apart by a sufficient distance to ensure that neither of them will be contacted by the belt, even under rather extreme conditions of flatwise vibration of the belt; and consequently the sensor assembly is not subject to wear.

As mentioned above, the back pressure chamber 44 for each nozzle pair is communicated with a pressure responsive control instrumentality that has two conditions, one corresponding to a high back pressure, the other to a low back pressure.

From the back pressure chamber for the middle low pressure nozzle 32, a connection extends to the pilot actuator of the pneumatic relay 40. As will be readily understood by those skilled in the art, that relay has such connections with said back pressure chamber and with the pneumatic tilting motor 22 that when the belt interposes itself between the middle nozzle pair, the idler roller is tilted in the proper direction to urge the belt edgewise away from the bight portion of the U-shaped arm. Such tilting is effected by the 20 p.s.i. pressure air applied to the pneumatic motor for bias. As the belt then moves to a position in which it is clear zone. the middle nozzle pair, high pressure is imposed upon the pilot actuator of the pneumatic relay, and that relay reverses its condition, causing the tilting motor to effect an opposite tilting of the idler roller whereby the belt is caused to begin moving back to the position at which it interposes itself between the nozzles 29 and 32. As explained above, the belt tracking control system is deliberately arranged to be an oscillatory one, rather than a stable system, so that the belt will be in more or less constant edgewise back-and-forth movement within the limits of the tracking zone, The back pressure chamber for each of the nozzles 31 and 33 is communicated with a double-throw pressure responsive switch, the switch associated with the nozzle 31 being designated by 45, that associated with the nozzle 33, by 46. One fixed contact terminal of each of the switches 45, 46 is connected in the energizing circuit for the electric motor 13, the other fixed contact is connected in an energizing circuit for the solenoid of the valve 38 that controls brake application. In the arrangement here illustrated, wherein an edge portion of the belt is normally interposed between the pair of nozzles 30, 33, but not between the nozzle pair 28, 31, the two switches are oppositely connected; that is, the switch 45 is in its condition for motor energization when high pressure prevails at its pressure responsive element, while the switch 46 is connected for motor energization when low pressure obtains at its pressure responsive element. Obviously, if an opposite pressure condition from the normal one is manifested at either of the switches 45 or 46, due to an out-of-bounds excursion of the belt in either direction, the electric motor is de-energized and the solenoid of the solenoid valve 38 is energized to cause pressure air to be fed to the brake mechanism.

Flow restrictors 48 are mounted in the circuit where desirable to limit the volume of pressure air issuing from the nozzles.

From the foregoing description taken with the accompanying drawings it will be apparent that this invention provides a compact sensor assembly for a wide belt sanding machine comprising a tracking sensor whereby normal edgewise oscillations of the belt within the tracking zone can be controlled and a pair of out-of-bounds sensors for detecting excursions of the belt beyond the tracking zone and stopping rotation of the contact drum in response to any such excessive excursion; and it will be further apparent that the sensor assembly of this invention is not subject to wear because it is not contacted by the belt and is self-cleaning and substantially maintenance-free.

Figures 3, 4:
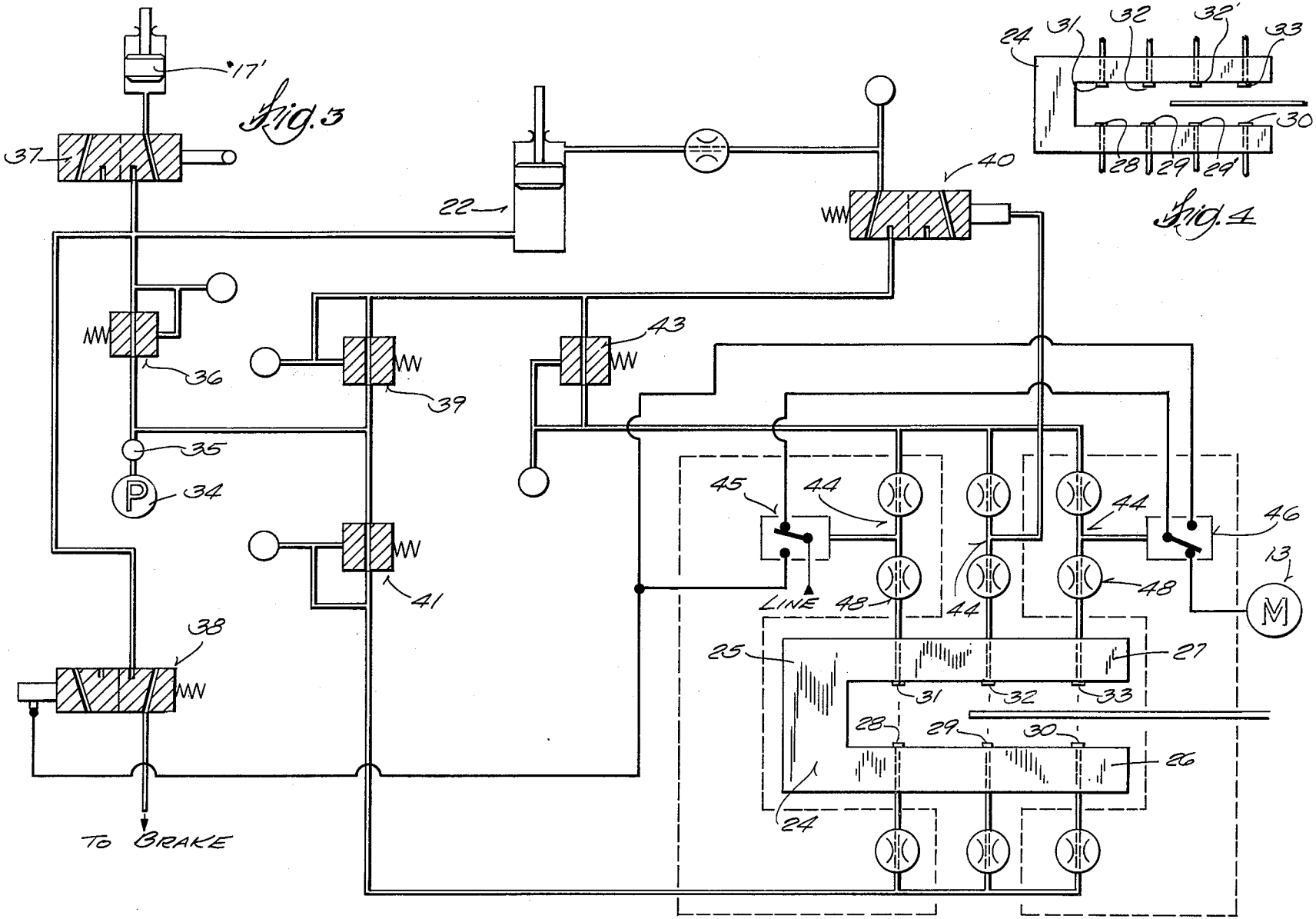
FIG. 3 is a diagram of the pneumatic circuit by which the sensor of this invention effects belt tracking control and stops the sanding machine in the event of abnormal edgewise movement of the belt.
FIG. 4 diagrammatically illustrates a modified embodiment of the sensor.

While activation of the air cylinder 22 to effect belt tracking oscillation of the belt tensioning idler roll has been shown and described as being produced by intermittently communicating the closed end of the cylinder with a source of air pressure greater than a biasing force maintained in the rod end of the cylinder, the same result can be obtained by alternately pressurizing the opposite ends of the air cylinder. In this case, an additional pair of opposed air discharge nozzles — as indicated by the numerals 29' and 32' in FIG. 4 — is required. This then gives the sensor assembly 24 an inner set of sensors 29–32 and 29'–32' and an outer set of sensors 28–31 and 30–33, at opposite sides of an imaginary line defined by the adjacent edge of the belt when the belt is at the midpoint of the range of its edgewise excursions within the bounds of the tracking zone. The inner set of sensors controls tracking of the belt and the outer set stops the machine in the event the belt leaves the tracking zone.

When edgewise movement of the belt 5 carries it from between the paired nozzles 29' and 32' of the inner set of sensors the belt tensioning roll is tilted in one direction and when the belt interposes itself between the other paired nozzles (29–32) of the inner set of sensors, it is tilted in the other direction.

The circuitry by which the response of the inner set of sensors to the presence and absence of the belt therebetween effects alternate pressurization of the opposite ends of the air cylinder 22 to effect the desired tracking of the belt will be obvious from the circuitry which has been shown and described. It will also be obvious that the addition of the fourth pair of nozzzles has no effect upon the functioning of the out-of-bounds sensors 28–31 and 30–33.

Those skilled in the art will appreciate that the invention can be embodied in forms other than as herein disclosed for purposes of illustration.

The invention is claimed and defined by the following claims:

1. In a belt-type abrading machine wherein power means drives an endless abrasive belt orbitally along a defined path which includes a substantially straight stretch, and an air motor effects back and forth edgewise excursions of the belt within the bounds of a predetermined tracking zone, wherein said air motor is controlled by signals resulting from the detection of the presence or absence of an edge portion of said stretch of the band by first sensor means in the form of paired opposing low pressure and high pressure air discharge nozzles so disposed with respect to one another and said edge portion of the belt that streams of air issuing from said nozzles unrestrictedly impinge upon one another when no part of said edge portion of the belt is interposed between the nozzles, and wherein the power means driving the belt is controlled by signals resulting from the detection of the presence or absence of an edge portion of said stretch of the belt by second sensor means in the form of two pairs of opposing low pressure and high pressure air discharge nozzles spaced apart transversely of said stretch of the belt and so disposed with respect to said edge portion of said stretch of the belt that streams of air issuing from the opposing low pressure and high pressure nozzles of each pair thereof unrestrictedly impinge upon one another when no part of said edge portion of the belt is interposed therebetween, the improvement whereby the signals that control the power means driving the belt and the air motor that effects back and forth edgewise excursions of the belt are both derived solely and directly from the direct impingement upon one another of the air streams issuing from their respective opposing nozzles, and which improvement comprises:

A. means providing separate sources of low and high pressure air;

B. low pressure duct means connecting the low pressure one of each pair of nozzles with the source low pressure air, each of said separate low pressure duct means including means defining pressure chamber means directly in series with the source of low pressure air and upstream of its respective low pressure nozzle;

C. high pressure duct means entirely separate from said low pressure duct means connecting the high pressure one of each pair of nozzles with the source of high pressure air so that unless intercepted by an edge portion of the belt, the air streams leaving the high pressure nozzles unrestrictedly enter the opposing low pressure nozzles with the result that the pressure in said pressure chambers is of one magnitude when such interception exists and of a different magnitude when it does not;

D. means directly responsive to changes in pressure in the pressure chamber means associated with the paired nozzles of the first sensor means operatively connected with said air motor operable to translate the detection of such changes into forces by which the functioning of said air motor is controlled; and E. means directly responsive to changes in pressure in the pressure chamber means associated with the paired nozzles of the second sensor means operatively connected with said power means and operable to translate the detection of such changes into forces by which the functioning of said power means is governed.

2. The invention defined in claim 1, further characterized in that the first sensor means as well as the second sensor means comprises two pairs of opposing low and high pressure air discharge nozzles spaced apart transversely of said stretch of the belt.

* * * * *